United States Patent [19]

Beckwith

[11] 4,096,706

[45] Jun. 27, 1978

[54] FREE CONDENSING LIQUID RETRO-PUMPING REFRIGERATION SYSTEM AND METHOD

[76] Inventor: Sterling Beckwith, 1824 Doris Dr., Menlo Park, Calif. 94025

[21] Appl. No.: 775,788

[22] Filed: Mar. 9, 1977

[51] Int. Cl.[2] ..... F25B 1/00; F25B 41/00; F25B 39/04

[52] U.S. Cl. ..... 62/115; 62/174; 62/509

[58] Field of Search ..... 62/115, 174, 504, 509, 62/512

[56] References Cited

U.S. PATENT DOCUMENTS

| | | | |
|---|---|---|---|
| 2,871,673 | 2/1959 | Richards et al. | 62/509 |
| 3,164,973 | 1/1965 | Watkins | 62/174 |
| 3,248,895 | 5/1966 | Mauer | 62/509 |
| 3,315,484 | 4/1967 | Ross | 62/174 |
| 3,353,367 | 11/1967 | Garland et al. | 62/174 |
| 3,844,131 | 10/1974 | Gianni et al. | 62/174 |
| 3,848,425 | 11/1974 | Watkins | 62/174 |

*Primary Examiner*—Lloyd L. King

[57] ABSTRACT

A compressor, condenser, pressure control valve, condensed liquid receiver, expansion valve and evaporator are arranged in circuit to provide a refrigeration system. The pressure control valve and condensed liquid receiver are bypassed by a pump tank and a pump in circuit between the output of the condenser and the expansion valve. A float switch in the pump tank provides an actuating signal at a predetermined level for condensed liquid in the pump tank, and the actuating signal is coupled to the pump. The pump, when actuated, draws condensed liquid from the pump tank at a free condensation pressure dependent upon ambient temperature at the condenser, and provides high pressure condensed liquid to the expansion valve. An inlet/-outlet line between the condensed liquid receiver and the expansion valve allows high pressure condensed liquid which is not passed by the expansion valve to be accumulated in the condensed liquid receiver. The method includes compressing a fluid in a gaseous phase and condensing the fluid to a liquid phase at a pressure corresponding to the ambient temperature of condensation. Collecting the condensed liquid phase fluid is followed by sensing the level of the collected condensed fluid and thereafter pumping the collected condensed fluid to a high pressure when the collected condensed fluid reaches a predetermined level. High pressure condensed fluid is expanded and evaporated in the refrigeration system, and/or accumulated as high pressure condensed fluid.

10 Claims, 4 Drawing Figures

FREE CONDENSING LIQUID RETRO-PUMPING REFRIGERATION SYSTEM AND METHOD

BACKGROUND OF THE INVENTION

The invention relates to refrigeration systems, and more particularly to improved efficiency refrigeration systems utilizing ambient temperatures and corresponding pressures for condensation of the refrigerant.

It is recognized that free condensation in a refrigeration circuit at relatively low pressures corresponding to ambient condenser temperatures coupled with subsequent pumping of the condensed fluid is a more efficient operation than condensation at a high constant pressure and subsequent routing of the condensed fluid through the refrigeration system at the high pressure. U.S. Pat. No. 2,949,750 discloses a refrigerating system of the evaporative type which uses an air-cooled condenser exposed to ambient temperatures. The system described therein is so constructed that when the condenser is subjected to low ambient temperatures and refrigerant condensed therein, satisfactory operating pressure is maintained at an expansion valve by pumping the condensed refrigerant to the operating pressure. A compressor supplies the condenser. When the compressor pressure falls below a predetermined level, a signal is provided which actuates a pump which supplies the expansion valve with condensed refrigerant at a sufficiently high pressure so that the expansion valve operates correctly. High pressure condensed liquid which is not passed by the expansion valve is recirculated through a relief valve to a receiver which contains only condensed liquid at low pressure. This recirculation is undesirable as unnecessary energy is expended recirculating the condensed liquid from a high pressure to a low pressure area and subsequently repressurizing the condensed liquid again before it passes through the expansion valve.

Another system is known wherein free condensation of a fluid in gaseous form occurs in a condenser at a pressure dependent upon ambient temperature surrounding the condenser. Condensed fluid is thereafter collected in a receiver at the relatively low pressure in the condenser and thereafter pumped by a liquid pump to a high condensed liquid pressure for delivery to an expansion valve associated with an evaporator in the refrigeration system. The pump speed is controlled by a differential pressure sensor located between the compressor and the pump outputs. Alternatively the system uses a pump with a variable output having the inherent possibility of overheating the condensed fluid when operating at low pressure differentials and low flow rates. As before, the condensed liquid receiver collects condensed fluid at the relatively low condenser pressure, and the condensed liquid supplied to the expansion valve may vary somewhat in pressure as the pressure sensors are called upon to detect the differential in compressor and pump output pressures.

A free condensing retro-pumping refrigeration system is needed in which the bulk of the condensed fluid is maintained at a substantially constant high pressure immediately available to the expansion valve.

SUMMARY AND OBJECTS OF THE INVENTION

In general, the disclosed refrigeration system has a compressor, a condenser, a pressure control valve, a receiver, an expansion valve and an evaporator connected in circuit. A pump tank providing no back pressure is connected to receive and collect condensed fluid from the condenser, so that fluid in a gaseous state may be delivered by the compressor to the condenser at a pressure corresponding to the ambient temperature at the condenser. A level sensing switch is provided in the pump tank which produces an output signal when the condensed fluid therein reaches a predetermined level. A pump is coupled to the pump tank and is actuated by the output signal, so that the condensed fluid in the pump tank at the relatively low condenser pressure is provided at the pump output at a high pressure. The high pressure condensed fluid is delivered to the expansion valve, and that fluid which is not passed by the expansion valve is accumulated in the receiver at the high pump pressure. Thereafter, high pressure condensed fluid is immediately available to the expansion valve from the receiver and directly from the pump when the pump is operating.

A method of providing a condensed fluid at a high pressure to an expansion valve connected to supply an evaporator is disclosed which includes the steps of compressing the fluid in gaseous form from the evaporator to a pressure which is dependent upon ambient temperature, and condensing the fluid at ambient temperature to a liquid phase. Collecting the liquid phase fluid and sensing the level of the collected liquid phase fluid is followed by pumping the condensed fluid to a high pressure when the collected condensed fluid level reaches a predetermined level. High pressure condensed fluid is delivered to the expansion valve.

It is an object of the present invention to provide a free condensing retro-pumping refrigeration system with improved efficiency, and with a stabilized supply of high pressure condensed liquid for a system expansion valve.

It is another object of the present invention to provide a free condensing retro-pumping refrigeration system which absorbs full pump flow during the retro-pumping operation.

Another object of the present invention is to provide a free condensing retro-pumping refrigeration system which avoids short cyling of the retro-pump.

Another object of the present invention is to provide a free condensing retro-pumping refrigeration system which maintains receiver pressure as high pressure condensed fluid is received therein.

Additional objects and features of the invention will appear from the following description in which the preferred embodiment has been set forth in detail in conjunction with the accompanying drawings.

BRIEF DECRIPTION OF THE DRAWINGS

DESCRIPTION OF THE PREFERRED EMBODIMENTS

Figure 1:
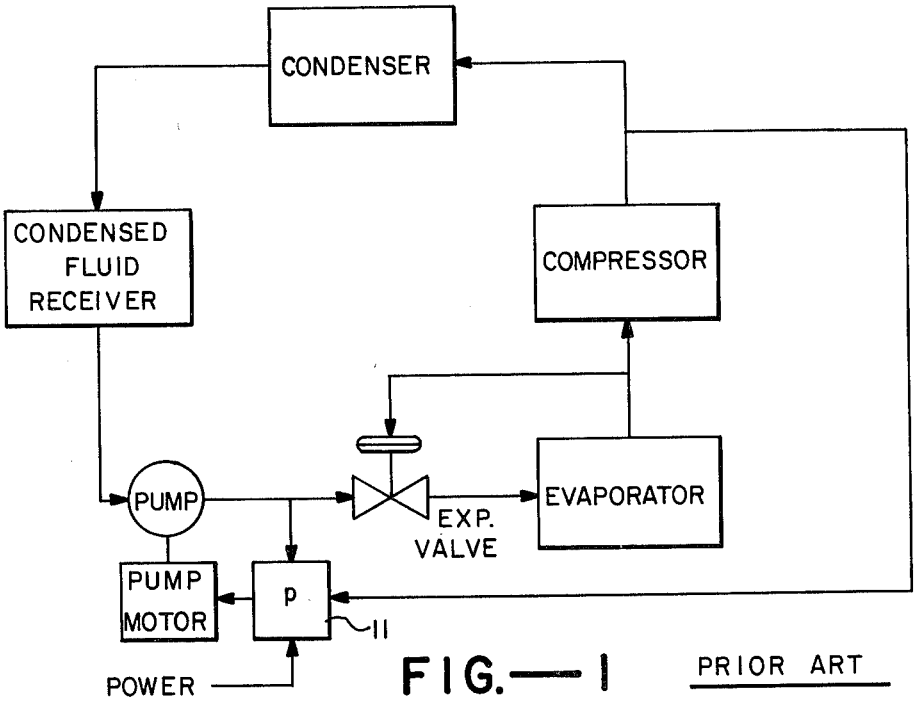
FIG.—1 PRIOR ART
FIG. 1 is a block diagram of a known refrigeration system.

The term "retro-pumping" as used herein refers to pumping of liquid phase refrigerant as opposed to gaseous phase. The free condensing retro-pumping system of FIG. 1 includes a compressor, a condenser, a condensed fluid receiver, a pump, an expansion valve and an evaporator in circuit. The compressor provides refrigerant in gaseous phase to the condensor at a pressure determined by the ambient temperature at the condenser. Refrigerant is condensed to liquid phase and collected in the system condensed fluid receiver. A pump is placed in the outlet from the condensed fluid receiver for pumping the liquid phase refrigerant to a high pressure which is connected to the expansion valve associated with the evaporator. A differential pressure sensor 11 is located between the high pressure sides of the compressor and the pump, and provides power to a pump motor for driving the pump at predetermined pressure differentials.

Figure 2:
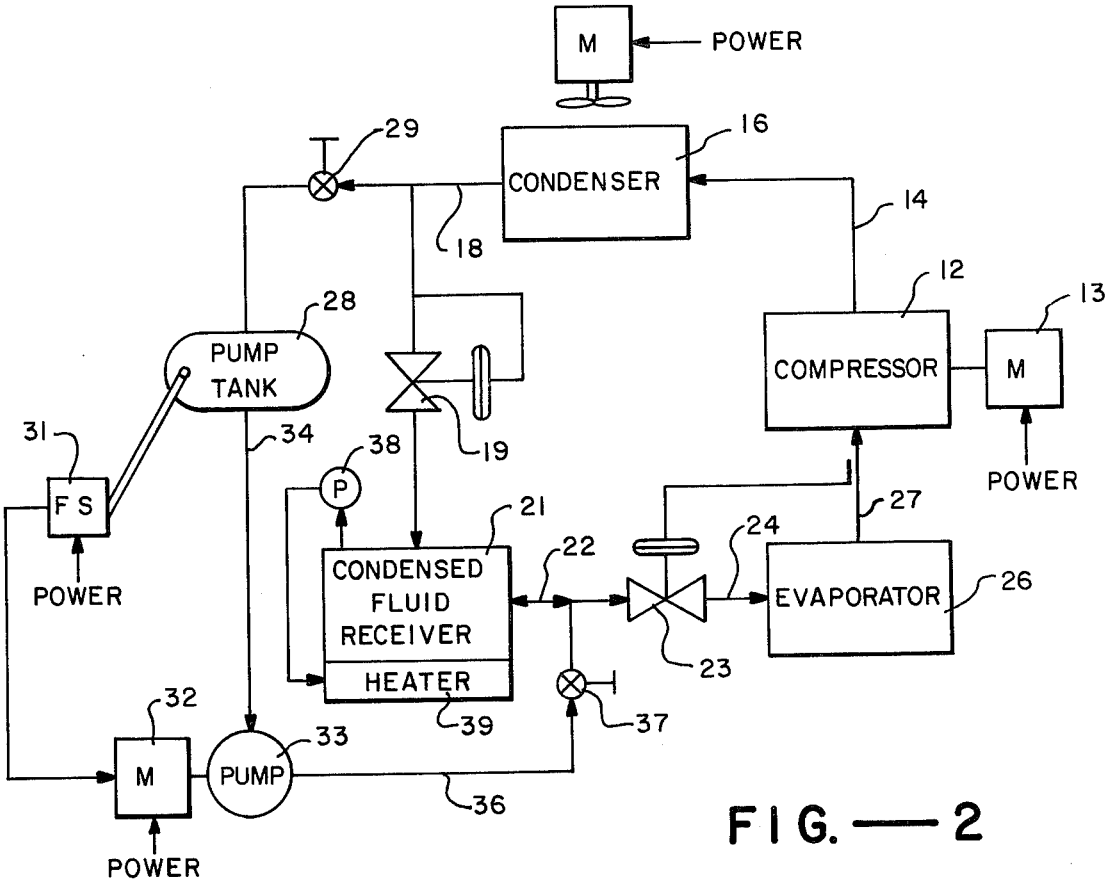
FIG. 2 is a block diagram of the disclosed free condensing retro-pumping refrigeration system.

A description of the disclosed refrigeration system will now be undertaken with reference to the block diagram of FIG. 2. A compressor 12 is driven by a motor 13 receiving driving power as shown. A line 14 is provided for conducting refrigerant in gaseous phase to a condenser 16. Condenser 16 has the usual motor powered fans 17 associated therewith for driving air at ambient temperature through the condenser 16. Condenser 16 has an outlet line 18 which is connected to a pressure control valve 19 situated between condenser 16 and a condensed fluid receiver 21. Pressure control valve 19 will not pass condensed fluid until a predetermined pressure exists at condenser outlet line 18 relative to atmospheric pressure. Thus, the pressure condensed fluid receiver 21 is maintained at the predetermined pressure. An inlet/outlet line 22 couples condensed fluid receiver 21 to an expansion valve 23. Expansion valve 23 is of the type which requires liquid phase refrigerant to be delivered at adequate pressure for proper operation. Expansion valve 23 is connected through line 24 to an evaporator 26. Evaporator 26 in turn emits refrigerant in gaseous phase which is conducted through a line 27 to the low pressure side of compressor 12 to complete a refrigerant circuit. Expansion valve 23 is the usual thermostatic type having a control associated with line 27 as shown.

Condenser outlet line 18 is also connected to a pump tank 28. A shut-off valve 29 is positioned in the inlet to pump tank 28. Pump tank 28 receives condensed fluid therein from condenser 16 at the pressure in condenser 16. A float switch 31 is situated in pump tank 28 operating to sense the level of condensed fluid therein. Float switch 31 serves to provide an actuating signal which connects power to a motor 32 when the condensed fluid reaches a predetermined upper level in pump tank 28. Motor 32 drives a pump 33 which is situated in an outlet line 34 from pump tank 28. When the predetermined upper level of condensed fluid in pump tank 28 is sensed by float switch 31 motor 32 is operated until a predetermined lower level of condensed fluid is reached in pump tank 28, thereby avoiding short cycling of pump 33. The level differential between the upper and lower levels is set at float switch 31. Condensed fluid at a high pressure is provided in a high pressure line 36 at the output of pump 33, and delivered through a high pressure shut-off valve 37 to the expansion valve 23. When expansion valve 23 is controlled to the closed position, high pressure condensed fluid is delivered through inlet/outlet line 22 to condensed fluid receiver 21. As a consequence, condensed fluid is pumped during a pumping cycle at a constant rate from pump tank 28 between the upper and lower predetermined levels therein, and delivered at a high pressure to expansion valve 23 and/or condensed fluid receiver 21. Condensed fluid receiver 21 operates as an accumulator for the high pressure condensed fluid which is not passed through expansion valve 23 during a pumping cycle for pump 33, and therefore determines the pressure in high pressure line 36.

High pressure condensed fluid in line 36 is delivered at a point enroute to expansion valve 23 such that it is not necessary for the high pressure condensed fluid to pass through condensed fluid receiver 21. This avoids cooling of condensed fluid receiver 21, and consequent pressure drop in the space above the high pressure condensed fluid contained therein. However, when high pressure condensed fluid is passed from high pressure line 36 through inlet/outlet line 22 to condensed fluid receiver 21 as the system transfers the full storage of condensed refrigerant from pump tank 28, some cooling and consequent pressure reduction in condensed fluid receiver 21 will occur. A pressure sensor 38 is provided to sense the pressure of the condensed fluid in condensed fluid receiver 21 and to provide an output signal indicative of such pressure. The output signal from pressure sensor 38 is coupled to a heater 39 adjacent to condensed fluid receiver 21 to elevate the temperature of the high pressure condensed fluid therein and thereby reestablish the desired high pressure above the fluid. As a result, expansion valve 23 always has sufficiently high pressure condensed fluid feed, which is a characteristic requirement for proper operation of such valve.

In the event pump 33 fails or the path for condensed refrigerant through pump tank 28, line 34, pump 33, and high pressure line 36 becomes unsuitable for conducting refrigerant, shut-off valve 29 may be actuated to the closed position and the refrigeration system of FIG. 2 will continue to function, though less efficiently. Compressor 12 will be required to provide refrigerant in gaseous phase to condenser 16 at a predetermined high pressure determined by pressure control valve 19. Condensed liquid phase refrigerant will thereafter pass pressure control valve 19 only when the concenser pressure is at or above the predetermined pressure above atmospheric pressure. It may be desirable to also close high pressure shut-off valve 37 in the event the discrepancy is in the form of a leak in high pressure line 36. In this fashion, the refrigerant circuit through pump tank 28 and pump 33 will be isolated at each end thereof and the refrigeration system will function as a conventional refrigeration system.

Figure 4:
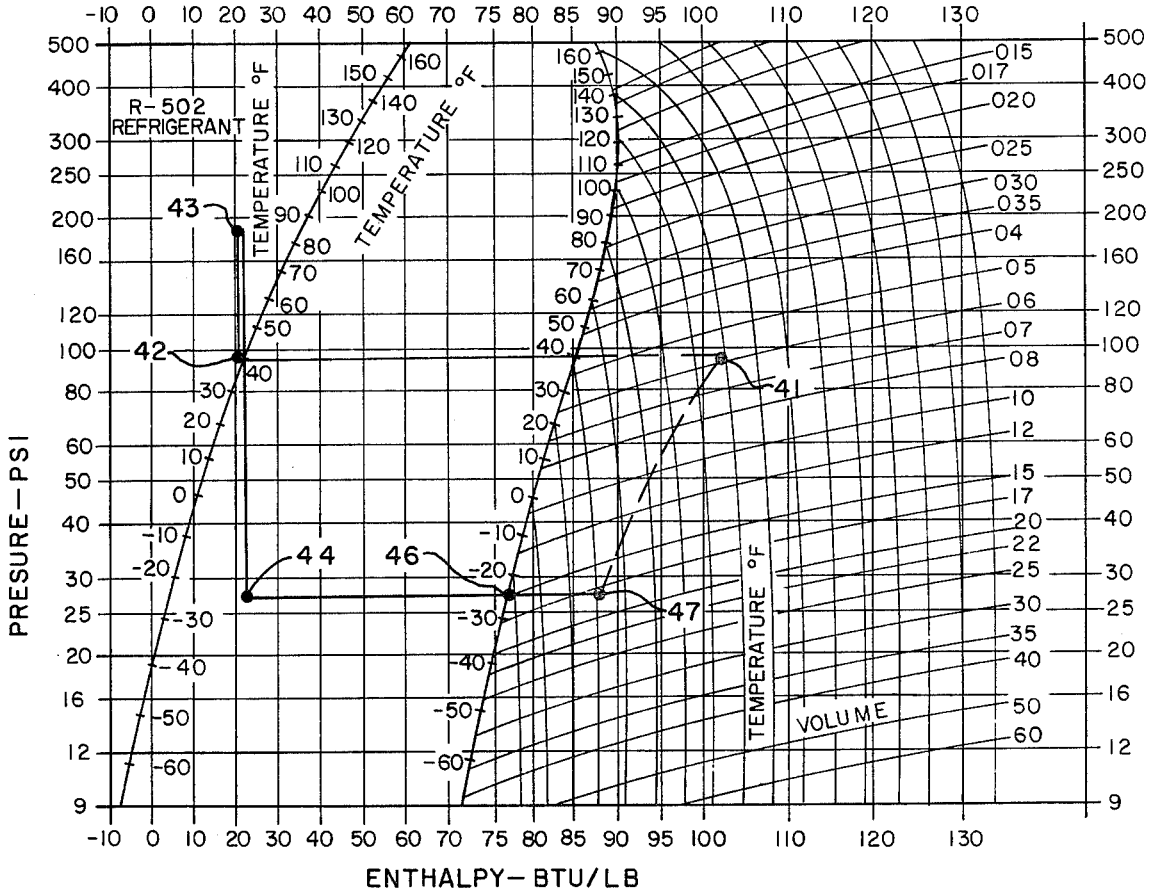
FIG. 4 is a pressure-enthalpy diagram showing a typical refrigeration cycle for the apparatus and method disclosed herein.

The manner in which the apparatus of FIG. 2 operates will now be described further in conjunction with the refrigerant cycle shown in FIG. 4 of the drawings. Beginning the cycle at line 14 at the high pressure side of compressor 12 the cycle is entered at point 41 of FIG. 4. Free condensation is shown occuring at about 40° F until the refrigerant in gaseous phase at point 41 assumes a condensed liquid phase at point 42. A free condensed liquid phase appears in condenser outlet line 18 at a pressure dependent upon the ambient temperature surrounding condenser 16. The free condensed liquid phase of point 42 is collected in pump tank 28, as described hereinabove, until the predetermined upper level is reached therein. When the predetermined upper level is sensed, pump 33 is driven by motor 32 and condensed liquid in pump tank 28 is pumped in liquid phase to a high pressure as seen at point 43 in FIG. 4. A condensed liquid is substantially imcompressible and therefore there is no temperature change with the pressure change between the points 42 and 43 of FIG. 4. The high pressure liquid phase refrigerant at point 43 at the outlet of pump 33 is allowed to expand through expansion valve 23, thereby traversing that portion of the refrigerant cycle in FIG. 4 from point 43 to point 44. Expansion is accompanied by a rapid drop in refrigerant temperature from 40° to approximately −26° F in the particular example of FIG. 4. Thereafter free evaporation takes place within evaporator 26 at a substantially constant pressure and temperature to a point 46 in the cycle. Thereafter, the refrigerant in gaseous form is no longer a saturated vapor and evaporation continues at constant pressure and increasing temperature to a point 47 in the cycle. Refrigerant in this condition is located in outlet line 27 from evaporator 26. Compression then takes place within compressor 12 between cycle points 47 and 41 of FIG. 4 to provide the refrigerant in gaseous form to condenser 16 at a pressure corresponding to the ambient temperature at condenser 16. Free condensation within condenser 16 then takes place, thereby repeating the portion of the refrigerant cycle between cycle points 41 and 42 as described above.

Figure 3:
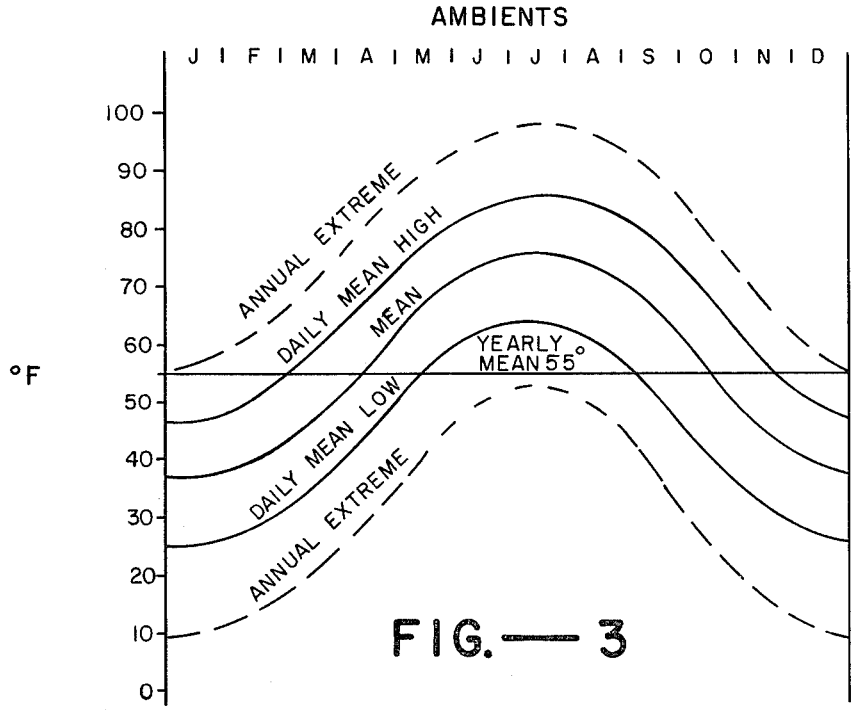
FIG. 3 is a typical mid-latitude annual ambient temperature excursion graph.

It may be seen by reference to FIG. 3 that compressor 12 need only provide refrigerant in gaseous form in line 14 of FIG. 2 at a pressure corresponding to the ambient temperature existing for the particular season of the year. FIG. 3 shows that the mean ambient temperature on approximately March 1 at the latitude represented by the graph of FIG. 3 is 40° F. A pressure of approximately 95 lbs. per square inch is required to be produced by compressor 12 in refrigerant *Freon 502, for example, in gaseous phase delivered to condenser 16. On January 1 compressor 12 need only provide a pressure of approximately 85 lbs. per square inch for *Freon 502 in the gaseous phase delivered to condenser 16 due to the lower mean temperature of approximately 36° F. On the other hand, on July 1, with a mean ambient temperature of approximately 70° F, compressor 12 must provide a pressure of approximately 155 lbs. per square inch in the gaseous phase refrigerant *Freon 502 delivered to condenser 16. It is clear therefore, that a refrigeration system requiring an outlet pressure of 155 lbs. per square inch the year around in *Freon 502 refrigerant would consume excess energy comparatively and be relatively inefficient as compared to a system of the type disclosed, wherein the pressure corresponds to the ambient temperature at the condenser 16 and free condensation occurs therein. Moreover, they system herein described requires only a relatively small volume compared to total system volume of the condensed refrigerant to collect in pump tank 28 prior to total transfer of the relatively small volume at full flow through pump 33 to expansion valve 23 and/or accumulator or condensed liquid receiver 21. Condensed refrigerant, once pumped to a high pressure by pump 33 is either utilized for refrigeration by being passed through expansion valve 23, or accumulated and retained at high pressure in condensed fluid receiver 21 for immediate future supply to expansion valve 23. Efficiency is enhanced by pumping liquid phase refrigerant as opposed to gaseous phase refrigerant, by pumping liquid phase refrigerant to a high pressure a full flow through pump 33 during a pumping period, by retaining all high pressure liquid phase refrigerant at high pressure until utilized for refrigeration, and by reducing the outlet pressure of gaseous phase refrigerant at the compressor to a pressure corresponding to the ambient temperature existing at the condenser.

*Trademark

There are different ways of accomplishing the normal refrigeration cycle during cold weather which do not utilize the pressure control valve 19 of FIG. 2. Such ways are known to those skilled in the art. The disclosed improvements to the basic refrigeration cycle apparatus may be used in conjunction with those different of accomplishing the normal refrigeration cycle.

What is claimed is:

1. A free condensing refrigeration system comprising
- an evaporator having an evaporator inlet and an evaporator outlet,
- a compressor having a low pressure port coupled to said evaporator outlet and a high pressure port,
- a condenser having a condenser inlet coupled to said high pressure port and a condenser outlet,
- a pressure control valve for opening at a predetermined pressure having an inlet side connected to said condenser outlet and an outlet side,
- a receiver coupled to said valve outlet side and having an inlet/outlet line,
- an expansion valve coupled between said inlet/outlet line and said evaporator inlet,
- a pump tank having a pump tank inlet coupled to said condenser outlet thereby receiving condensed liquid and having a pump tank outlet,
- a switch in said pump tank transmitting an electrical output signal when the fluid in said pump tank reaches a predetermined upper level,
- a pump in communication with said pump tank outlet line being actuated by said electrical outlet signal, said pump having a high pump pressure outlet port coupled to said inlet/outlet line,
- whereby said receiver acts as an accumulator for condensed liquid at high pressure.

2. A free condensing refrigeration system as in claim 1 together with a shut-off valve in said pump tank inlet, whereby when said shut-off valve is closed condensed fluid flows through said pressure control valve when the predetermined pressure is reached.

3. A free condensing refrigeration system as in claim 1 where said switch provides a signal when the fluid in the pump tank reaches a predetermined lower level so that short cycling of said pump is avoided.

4. A free condensing refrigeration system as in claim 1 together with a pressure sensor in said receiver providing a pressure indicative output,
- and a heater adjacent to said receiver responsive to said pressure indicative output, whereby said high pressure is maintained in the receiver and the condensed fluid supplied to said expansion valve.

5. In a refrigeration system having a compressor, a condenser, a pressure control valve, a receiver, an expansion valve, and an evaporator in circuit, the improvement comprising
- a pump tank connected to recieve condensed fluid from the condenser,
- a level sensing switch in said pump tank providing an output signal when condensed fluid reaches a predetermined level therein,
- a pump having an inlet coupled to said pump tank and being actuated by said output signal, whereby high pressure condensed fluid is provided at an outlet on said pump,
- and means for conducting the high pressure condensed fluid from the pump to the receiver and the expansion valve, whereby free condensation of a fluid occurs in the condenser at a pressure determined by ambient temperature at the condenser and the compressor need only supply fluid at such pressure.

6. A refrigeration system as in claim 5 wherein the receiver operates as an accumulator receiving high pressure condensed fluid which is not passed through the expansion valve, whereby temperature in the receiver is reduced thereby reducing receiver pressure, together with a pressure sensor in the receiver providing a control output indicative thereof, and means for heating the receiver actuated by said control output, whereby receiver pressure is raised to provide condensed fluid to the expansion valve at a high pressure.

7. A refrigeration system as in claim 5 together with means for shutting-off said pump tank, whereby pressure in the receiver is determined by the pressure control valve.

8. The method of providing a condensed fluid at a high pressure to an expansion valve coupled to an evaporator, comprising the steps of compressing the fluid in gaseous phase from the evaporator to a pressure dependent upon ambient temperature, condensing the fluid at ambient temperature to a liquid phase, collecting the liquid phase fluid, sensing a predetermined level of the collected liquid phase fluid, pumping the liquid phase fluid to a high pressure when the predetermined level is reached, and delivering the high pressure liquid phase fluid to the expansion valve.

9. The method of claim 8 wherein the expansion valve is controlled between an open and closed position, together with the step of accumulating the high pressure liquid phase fluid when the expansion valve is in the closed position.

10. The method of claim 9 wherein newly accumulated high pressure liquid phase fluid reduces temperature and pressure associated with previously accumulated high pressure liquid phase fluid, together with the steps of sensing the pressure over the accumulated high pressure liquid phase fluid, and heating the same when the sensed pressure falls.

* * * * *